United States Patent [19]

Yoshimura et al.

[11] Patent Number: 5,039,440

[45] Date of Patent: Aug. 13, 1991

[54] TRACTION FLUID

[75] Inventors: Narihiko Yoshimura; Hirotaka Tomizawa, both of Saitama, Japan

[73] Assignee: Toa Nenryo Kogyo, K.K., Tokyo, Japan

[21] Appl. No.: 175,932

[22] Filed: Mar. 31, 1988

[51] Int. Cl.[5] ..... C09K 5/00

[52] U.S. Cl. ..... 252/79; 252/73; 252/57; 252/565; 560/1; 560/188; 560/193

[58] Field of Search ..... 252/73, 79, 565, 57; 560/1, 188, 193

[56] References Cited

U.S. PATENT DOCUMENTS

| | | | |
|---|---|---|---|
| 2,016,392 | 10/1935 | Schneider | 260/99.40 |
| 2,807,638 | 9/1957 | Morris et al. | 260/468 |
| 3,133,021 | 5/1964 | Gisser et al. | 252/34.7 |
| 3,440,894 | 4/1969 | Hammann et al. | 74/200 |
| 3,595,797 | 7/1971 | Duling et al. | 252/73 |
| 3,803,037 | 4/1974 | Wygant | 252/32.7 |
| 3,871,837 | 3/1975 | Bedague et al. | 44/58 |
| 4,178,261 | 12/1979 | Dhein et al. | 252/57 |
| 4,292,187 | 9/1981 | Hentschel et al. | 252/49.5 |
| 4,343,652 | 8/1982 | Allart et al. | 106/21 |
| 4,464,277 | 8/1984 | Cousineau et al. | 252/56 |
| 4,499,000 | 2/1985 | Hentschel | 252/73 |
| 4,507,408 | 3/1985 | Torbus et al. | 523/143 |
| 4,514,190 | 4/1985 | Cousineau et al. | 44/70 |
| 4,519,932 | 5/1985 | Schnur et al. | 252/73 |
| 4,589,990 | 5/1986 | Zehler et al. | 252/56 |
| 4,606,833 | 8/1986 | Schuettenberg et al. | 252/49 |
| 4,886,614 | 12/1989 | Yoshimura et al. | 252/79 |

FOREIGN PATENT DOCUMENTS

| | | |
|---|---|---|
| 786950 | 11/1957 | United Kingdom . |
| 1593113 | 7/1981 | United Kingdom . |

OTHER PUBLICATIONS

Acylation of Glycerol. Ismailov et al., 1971, No. 2, 49-54 (Russ.) From Ref. Zh., Khim, 1972, Abstr. No. 4Zh180.

Corina et al., J. Chromatogr. 260 (1) 51-62, 1983.

*Primary Examiner*—Lester L. Lee
*Assistant Examiner*—E. J. Kraus
*Attorney, Agent, or Firm*—R. A. Maggio

[57] ABSTRACT

A traction fluid comprising at least one compound selected from diesters or monoesters represented by general formulas

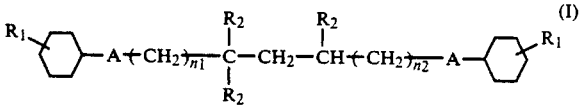

(I)

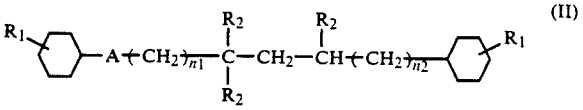

(II)

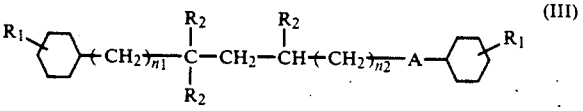

(III)

wherein:

A is an ester linkage

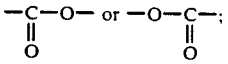

$n_1$ and $n_2$ are independently integers having a value of from 0 to 5 inclusive;

$R_1$ is hydrogen or a $C_1$-$C_8$ alkyl; and $R_2$ is a $C_1$ to $C_3$ alkyl group.

8 Claims, No Drawings

TRACTION FLUID

FIELD OF THE INVENTION

This invention relates to traction fluid comprising a diester compound or a monoester compound containing terminal cyclohexyl rings and a 1,1,3-trialkyl propylene group between said terminal cyclohexyl moieties.

BACKGROUND OF THE INVENTION

Traction drive power transmissions which transmit power to a driven part through a traction drive mechanism have attracted attention in the field of automobiles and industrial machinery, and in recent years extensive research and development has been conducted in this area. The traction drive mechanism is a power transmitting mechanism. Unlike conventional drive mechanisms it does not use any gears. This results in a reduction in vibration and noise as well as a smooth speed change in high-speed rotation. An important goal in the automobile industry is improvement in the fuel consumption of automobiles. It has been suggested that if the traction drive is applied to the transmission of automobiles in order to convert the transmission to a continuous variable-speed transmission the fuel consumption can be reduced by at least 20% compared with conventional transmission systems. This is due to the fact that the drive can always be in the optimum fuel consumption region of an engine. Recent studies have been conducted in the areas of development of materials having high fatigue resistance, and in the theoretical analysis of traction mechanisms. Regarding the traction fluid, the correlation of traction coefficients is gradually being understood on a level of the molecular structure of the components. The term "traction coefficient" as used herein is defined as the ratio of the tractional force which is caused by slipping at the contact points between rotators which are in contact with each other in a power transmission of the rolling friction type to the normal load.

The traction fluid is required to be comprised of a lubricating oil having a high traction coefficient. It has been confirmed that a traction fluid possessing a molecular structure having a naphthene ring exhibits a high performance. "Santotrack®" manufactured by the Monsanto Company is widely known as a commercially available traction fluid. Japanese Patent Publication No. 357363/1972 discloses di(cyclohexyl)alkane and dicyclohexane as traction fluids having a naphthene ring. This patent publication discloses that a fluid obtained by incorporating the above-mentioned alkane compound in perhydrogenated (α-methyl) styrene polymer, hydrindane compound or the like has a high traction coefficient. Japanese Patent Laid-Open No. 191797/1984 discloses a traction fluid containing an ester compound having a naphthene ring. It discloses that an ester obtained by the hydrogenation of the aromatic nucleus of dicyclohexyl cyclohexane-dicarboxylate or dicyclohexyl phthalate is a preferred tractive fluid.

As mentioned above the development of continuous variable-speed transmissions has advanced in recent years. The higher the traction coefficient of the traction fluid the larger the transmission force. This allows a reduction in the size of the device which in turn results in a reduction in emission of polluting exhaust gases. Therefore, there is a strong demand for a fluid having a traction coefficient which is as high as possible. However, the use of a conventional traction fluid which exhibits the highest performance of all the currently commercially available fluids in such a traction drive device provides unsatisfactory performance with respect to the traction coefficient. Such conventional fluids are also expensive. The traction fluid which has been proposed in Japanese Patent Publication No. 357363/1971 contains Santotrack® or its analogue as a component and, therefore, is also unsatisfactory with respect to performance and cost.

The present inventors have made extensive and intensive studies with a view to developing a traction fluid which not only exhibits a high traction coefficient but is also inexpensive. As a result, the present inventors have discovered that the incorporation of an ester having two cyclohexyl rings or its derivative, or said ester in combination with a branched poly-α-olefin, can provide an economical, high-performance base oil fluid. The present invention is based on this discovery.

SUMMARY OF THE INVENTION

Traction fluids comprising a monoester compound or diester compound containing two terminal cyclohexyl rings and a 1,1,3-trialkyl propylene group between said terminal cyclohexyl moieties.

DETAILED DESCRIPTION OF THE INVENTION

In accordance with a first embodiment of the present invention there is provided a traction fluid comprising a base compound containing terminal cyclohexyl rings, and a central portion comprising a divalent 1,1,3-trialkyl propylene group. These compounds are represented by general formulas (I), (II), and (III).

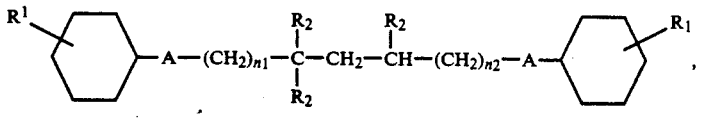

(I)

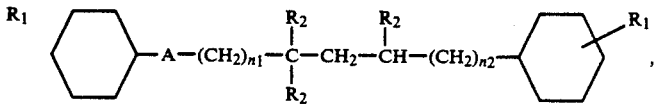

(II)

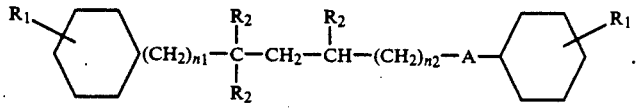

(III)

A in the above formulas (I), (II), and (III) indicates an ester linkage

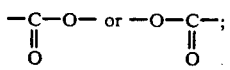

$n_1$ and $n_2$ are the same or different and are an integer within 0 to 5, preferably 0 to 2; $R_1$ is selected from a hydrogen atom or $C_1$ to $C_8$ alkyl group; and $R_2$ is independently $C_1$–$C_3$ alkyl group.

The base compound comprising the traction fluid of the present invention is characterized by possessing two terminal cyclohexyl rings and a specific 1,1,3-trialkyl propylene group between these two terminal cyclohexyl rings.

The compounds represented by the aforementioned general formulas (I), (II) or (III) possess the following properties: viscosity of 15 to 70 cst, preferably 30 to 60 cst, at a temperature of 40° C., and 3 to 10 cst, preferably 4 to 7 cst, at a temperature of 100° C.; and a viscosity index within the range of 30 to 100, preferably 30 to 60.

The compounds represented by the aforementioned general formulae (I), (II), or (III) can be produced by the following methods. First, a method for producing the compounds of the following general formulae will be explained

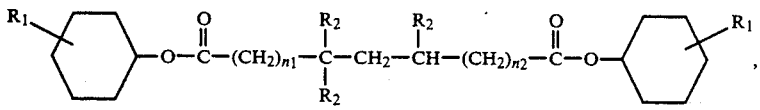

(I')

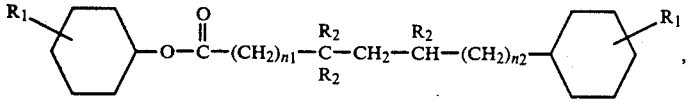

(II')

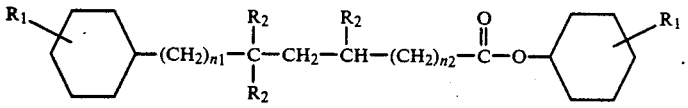

(III')

These compounds can be prepared by the esterification reaction of cyclohexanol compound with dicarboxylic acid containing a 1,1,3-trialkyl propylene group in the molecule (e.g. 2,2,4-trimethyl adipic acid, 2,4,4-trimethyl adipic acid), or monocarboxylic acid containing terminal cyclohexyl rings and 1,1,3-trialkyl propylene group in its central part (e.g. 6-cyclohexyl-3,5,5-trimethyl hexanoic acid). The cyclohexanol compounds can include cyclohexanol or methyl cyclohexanol.

The esterification reaction of these compounds is preferably carried out in the presence of an excess of alcohol. That is, in the case of (I'), 2 to 6 moles (preferably 2.4 to 4 moles) or cyclohexanol compound is reacted with one mole of dicarboxylic acid. In the case of (II') and (III'), 1 to 3 moles (preferably 1.2 to 2 moles) of cyclohexanol compound is reacted with one mole of monocarboxylic acid. The reaction temperature is from about 150° to 250° C., preferably 170° to 230° C., and the reaction time is from 10 to 40 hours, preferably 15 to 25 hours. In addition, the reaction pressure conditions can vary from pressurized to reduced. From a viewpoint of reaction processing, however, the pressure condition under which the reaction is carried out is preferably atmospheric pressure. Under these conditions, excess acid can be used as a catalyst. Moreover, suitable amount of alkyl benzene such as xylene and toluene can be added as a solvent. Addition of a solvent enables the reaction and temperature to be easily controlled.

For compounds which are difficult to esterify due to steric hindrance of the alkyl group of the carboxylic acid a catalyst can be used. This catalyst includes compounds such as phosphoric acid, pass toluene sulfonic acid and sulfuric acid. From a viewpoint of increasing the reaction rate and yield of the ester, however, sulfuric acid is the preferred catalyst.

Water which has been generated in the reaction is gradually vaporized during the course of the reaction, and the reaction is completed at the time when the water vaporized amounts to twice the moles of the dicarboxylic acid in the case of (I'), and to equimolar amounts of the monocarboxylic acid in the case of (II') and (III'). After completion of the reaction, the unreacted acid and catalyst is removed by alkali washing, and in the end water, solvent and excess alcohol is discharged by reduced distillation.

Next, the method for producing the compounds of the following general formulae will be explained

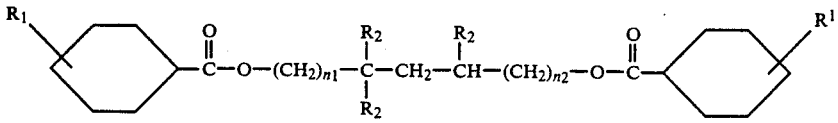

(I'')

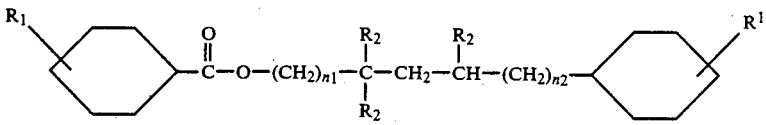

(II'')

-continued

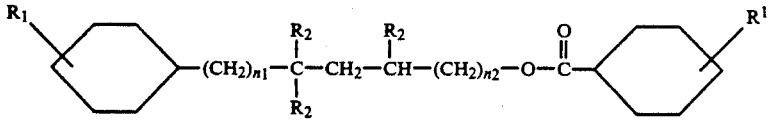

(III")

These compounds can be prepared by the esterification reaction of cyclohexane carboxylic acid compound with dihydric alcohol containing a 1,1,3-trialkyl propylene group in the molecule (e.g. 1,1,3-trimethyl butane-1,4,diol or 2,2,4-trimethyl pentane-1,5,diol), or a monohydric alcohol containing terminal cyclohexyl rings and 1,1,3-trialkyl propylene group in its central part (e.g. 2,4-trimethyl-5-cyclohexyl pentanol or 2,4,4-trimethyl-6-cyclohexyl hexanol). The cyclohexane carboxylic acid compounds include cyclohexyl carboxylic acid or methyl cyclohexane carboxylic acid.

Esterification is preferably carried out in the presence of an excess of acid. That is, in the case of (I"), 2 to 6 moles (preferably 2.4 to 4 moles) cyclohexanol compound is reacted with one mole of diol. In the case of (II") and (III"), 1 to 3 moles (preferably 1.2 to 2 moles) carboxylic acid is reacted with one mole of monovalent alcohol. The reaction temperature is from about 150° to 250° C. preferably 170° to 230° C., and the reaction time is from 10 to 40 hours, preferably 15 to 25 hours. In addition, the reaction pressure can vary from superatmospheric to subatmospheric. From a viewpoint of reaction processing, however, atmospheric pressure is preferred. Under these conditions, excess acid can be used as a catalyst. Moreover, suitable amounts of alkyl benzene such as xylene and toluene can be used as a solvent. Addition of a solvent enables the reaction and temperature to be easily controlled.

For any compound which is difficult to esterify due to steric hindrance of the alkyl group of the alcohol catalysts can be used. As the catalyst, any compound such as phosphoric acid, para toluene sulfonic acid and sulfuric acid can be used. From a viewpoint of increasing the reaction rate and yield of the ester, however, sulfuric acid is the most preferred catalyst.

Water which has been generated during the reaction is gradually vaporized during the course of the reaction, and the reaction is complete at the time when the water vaporized amounts to twice the molar amount of the alcohol, in the case of (I"), and to equimolar amounts of the alcohol in the case of (II") and (III"). After completing the reaction, the excess acid and catalyst is removed by alkali washing and in the end, water, solvent and excess alcohol is discharged by reduced distillation.

The ester compounds of the present invention such as the diester of 2,2,4-trimethyl adipic acid and cyclohexanol, or the monoester of 6-cyclohexyl-3,5,5-trimethyl hexanoic acid and cyclohexanol exhibit traction coefficients of 0.107 to 0.110. For this reason, the ester compounds of the present invention exhibit high performance even if only the ester compound is used in a traction drive device.

The esters of the present invention used alone in a traction drive device exhibit a high traction coefficient. However, they may be blended with a second component such as a base oil. That is, the component selected as the second component is one which improves traction coefficient by a synergistic effect with the cyclohexyl rings of the ester compounds of the present invention. Moreover, they have excellent viscosity characteristics and are relatively inexpensive. Blending of the aforementioned second component with the ester compounds of the present invention provides a very economical traction fluid. The amount of the second component blended with the ester compound is in general from 0.01 to 90 wt %, particularly preferably from 0.1 to 70 wt %, more preferably 1 to 30 wt %.

The aforementioned second component includes, for example, cyclohexyl methacrylate and polyolefin. Furthermore, as the polyolefin, poly-α-olefin, olefin copolymer and the polymer obtained by saturation of the unsaturated linkages thereof with hydrogen are included. The poly-α-olefin has either a quaternary carbon atom or a tertiary carbon atom in its main chain and is a polymer of an α-olefin having 3 to 5 carbon atoms or the hydrogenation product thereof. Examples of the poly-α-olefins include polypropylene, polybutene, polyisobutylene and polypentene and the hydrogenation products thereof. Particularly preferred are polybutene and polyisobutylene and the hydrogenation products thereof. The polyisobutylene is represented by the following structural formula

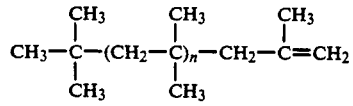

The hydrogenation product of the polyisobutylene is represented by the following structural formula:

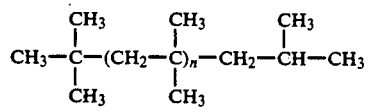

In the above formulas the degree of polymerization, n, is 6 to 200.

Although the polybutene and polyisobutylene are commercially available, they may also be produced by conventional polymerization methods. The hydrogenation product thereof is produced by reacting polyisobutylene or the like in the presence of hydrogen. The molecular weight of the poly-α-olefin is preferably in the range of 500 to 10,000, more preferably in the range of 900 to 5,000. The molecular weight can be adjusted by suitable methods such as decomposition of a poly-α-olefin having a high molecular weight or blending of poly-α-olefin having different molecular weights. An olefin copolymer (OCP) is obtained by polymerization of two or more olefins selected from ethylene, propylene, butene, pentene or styrene. OCP has a structure in which these olefins are irregularly linked, as opposed to poly-α-olefins such as polybutene which have a regular gem-dialkyl structure.

The ester of the present invention, e.g., a diester of 2,2,4-trimethyl adipic acid and cyclohexanol exhibits a traction coefficient of 0.110. Polybutene of the second component exhibits a traction coefficient of 0.075 to 0.085. However, a blend thereof provides a fluid with a traction coefficient of 0.115 to 0.120.

Various additives may also be added to the traction fluid of the present invention depending on its applications. Specifically, when the traction device operates at high temperatures and large loads at least one additive selected from among an antioxidant, a wear inhibitor and a corrosion inhibitor may be added in an amount of 0.01 to 5% by weight. Similarly, when a high viscosity index is required a known viscosity index improver is added in an amount of 1 to 10% by weight.

The term "traction fluid" as employed in the present invention is intended to mean a fluid used in devices which transmit a rotational torque through spot contact or line contact, or used in transmissions having a similar structure. The traction fluids of the present invention exhibit a traction coefficient higher than those of conventionally known fluids, i.e., exhibit a traction coefficient about 10 to 15% higher than those of the conventional fluids, although the value varies depending on the viscosity. Therefore, the traction fluid of the present invention can be advantageously used for relatively low power drive transmissions including internal combustion engines of small passenger cars, spinning machines and food processing machines, as well as large power drive transmissions such as industrial machines, etc.

The traction fluids of the present invention exhibit remarkably superior traction coefficient compared to conventional fluids. The reason why the traction fluids of the present invention exhibit a high traction coefficient is not yet fully understood. However, basically the reason is believed to reside in the unique molecular structure of the traction fluids of the present invention.

First, the diester compound, e.g., shown in general formula (I), of the present invention has two cyclohexyl rings and ester linkages in its molecule, which bring about an interdipolar force between the molecules. It is believed that the interdipolar force serves to bring the fluid into a stable glassy state under high load conditions, thereby increasing the shearing force. Further, the traction fluids of the present invention have a 1,1,3-trialkyl propylene group, which is engaged with the two cyclohexyl rings through the ester linkage. This makes the rotation of the structure in the molecule difficult. Therefore, when the traction device is under high load conditions the cyclohexyl rings are firmly engaged, like gears, with the quarternary carbon atom portion, while when the device is released from the load this engagement is quickly broken, thereby causing fluidization.

The following Examples are provided for illustrative purposes only and are not to be construed as limiting the invention herein described.

EXAMPLES 1 TO 3

Traction fluids (compounds $A_1$ and $A_2$) of this invention shown in the following formulas are synthesized using xylene as a solvent, at a temperature range of from 170° to 230° C. for 15 to 25 hours under atmospheric pressure.

$A_1$: 2.2.4 - trimethyl adipic acid and cyclohexanol, and
$A_2$: 2.4.4 - trimethyl adipic acid and cyclohexanol.

$A_1$:

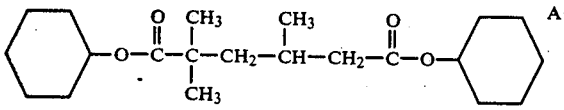

-continued $A_2$:

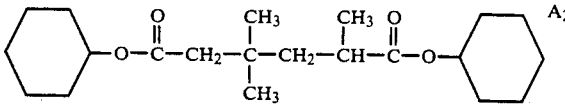

Next, the traction coefficients of thus prepared compounds $A_1$ and $A_2$ were measured.

Example 1 contains compound $A_1$, example 2 contains compound $A_2$ and example 3 contains a mixture of compounds $A_1$ and $A_2$.

In addition, the measurement conditions of the traction coefficients are as follows. Measurement conditions:

Measurement equipment: Soda-type four roller traction test machine.

Test conditions: 15° C. fluid temperature 15° C. roller temperature 1.2 GPa mean Hertzian pressure, 3.6 m/s rolling velocity, and 3.0% slipping ratio.

The traction fluid of this invention is found to be remarkably superior in its traction performance compared to the commercialized ones, as shown by the data in Table 1.

COMPARATIVE EXAMPLES 1 TO 4

The samples used here for comparison are a commercial traction fluid B (Santotrack ® by Monsanto Co.), commercialized naphthenic fluids $C_1$ and $C_2$ (possessing 1-3 cyclohexyl rings) and phthalic acid dicyclohexyl ester D. Traction coefficients of these samples were measured under the conditions described in examples 1 to 3.

The results of this measurement are shown in Table 1, which shows that any sample used here for comparison exhibits a traction coefficient 10-15% smaller than that of the diester compounds of this invention.

TABLE 1

| Sample | 40° C. Vis (cst) | 100° C. Vis. (cst) | Viscosity Index | Traction coefficient |
|---|---|---|---|---|
| Ex. 1 ($A_1$) | 44.04 | 5.493 | 31.7 | 0.111 |
| Ex. 2 ($A_2$) | 35.32 | 4.974 | 38.4 | 0.107 |
| Ex. 3 ($A_1 + A_2$) | 39.44 | 5.227 | 35.5 | 0.110 |
| C. Ex. 1 (B) | 19.98 | 3.53 | 9.0 | 0.100 |
| C. Ex. 2 ($C_1$) | 8.64 | 2.17 | 24.8 | 0.090 |
| C. Ex. 3 ($C_2$) | 69.63 | 5.94 | −66.5 | 0.095 |
| C. Ex. 4 (D) | 262.6 | 9.905 | −184 | 0.100 |

EXAMPLE 4

A traction fluid of example 3 is blended with 10 wt. % of polybutene having an average molecular weight 1,280. The characteristics of this fluid are 63.13 (cst) at 40° C., 7.290 (cst) at 100° C., viscosity index of 64.8, and a traction coefficient of 0.115.

EXAMPLE 5

A traction fluid of this invention is synthesized from 6-cyclohexyl-3,5,5-trimethylhexanoic acid and cyclohexanol and is represented by the formula

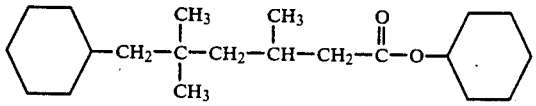

The characteristics of this fluid are 28.07 (cst) at 40° C., 4.30 (cst) at 100° C., a viscosity index of 14.52, and a traction coefficient of 0.107.

The present invention is directed to a traction fluid containing a base oil comprised of a diester or monoester having terminal cyclohexyl rings central and 1,1,2-trialkyl propylene groups. The traction fluid not only exhibits extremely high traction coefficients but is also inexpensive and has excellent viscosity characteristics.

Therefore, the use of the traction fluid of the present invention in a power transmission, particularly a traction drive device, leads to a remarkable increase in shearing force under a high load. This enables a reduction in size of the device resulting in a reduction in cost of said device.

What is claimed:

1. A traction fluid comprising a major amount of at least one compound selected from diesters or monoesters represented by the formulae

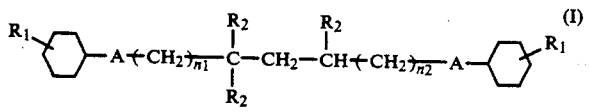

(I)

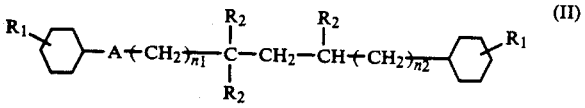

(II)

-continued

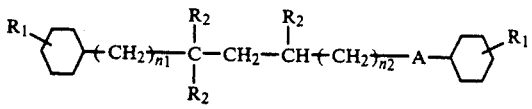

(III)

wherein:

A is an ester linkage

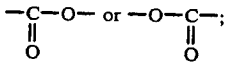

$n_1$ and $n_2$ are independently integers having a value of from 0 to 5 inclusive;

$R_1$ is hydrogen or a $C_1$–$C_8$ alkyl; and $R_2$ is a $C_1$ to $C_3$ alkyl group; and a minor amount of at least one material selected from the group consisting of antioxidants, wear inhibitors, corrosion inhibitors and viscosity index improvers.

2. The fluid according to claim 1, wherein $R_1$ is hydrogen or a $C_1$ to $C_4$ alkyl group.

3. The fluid according to claim 1, wherein $n_1$ and $n_2$ are independently integers having a value of from 0 to 2 inclusive.

4. The fluid according to claim wherein $R_2$ is a methyl radical.

5. The fluid according to claim 1, wherein said compound is a diester represented by formula (I).

6. The fluid according to claim 1, wherein said compound is a monoester represented by formula (II), (III) or mixtures thereof.

7. The fluid according to claim 6, wherein said monoester is represented by formula (II).

8. The fluid according to claim 6, wherein said monoester is represented by formula (III).

* * * * *